United States Patent [19]

Goode et al.

[11] 4,434,902

[45] Mar. 6, 1984

[54] APPARATUS FOR EXTENDING AND RETRACTING A MANUAL BOOM SECTION

[75] Inventors: Frederick R. Goode, Lexington; John D. Evans, Nicholasville; James W. Cox, Jr., Lexington, all of Ky.

[73] Assignee: FMC Corporation, Chicago, Ill.

[21] Appl. No.: 240,727

[22] Filed: Mar. 5, 1981

[51] Int. Cl.[3] ..... B66C 23/04

[52] U.S. Cl. ..... 212/268; 52/118

[58] Field of Search ..... 212/267, 268, 266, 270; 52/115, 118; 74/545; 403/2

[56] References Cited

U.S. PATENT DOCUMENTS

| | | | |
|---|---|---|---|
| 3,171,545 | 3/1965 | Knight et al. . | |
| 3,243,052 | 3/1966 | Grove . | |
| 3,368,696 | 2/1968 | Johnston et al. | 212/268 |
| 3,386,594 | 6/1968 | Grove . | |
| 3,398,645 | 8/1968 | Nansel . | |
| 3,462,023 | 8/1969 | Grove . | |
| 3,648,850 | 3/1972 | Rochon et al. | 212/267 |
| 3,770,138 | 11/1973 | Chalupsky et al. | 52/115 |
| 3,795,321 | 3/1974 | Johnston . | |
| 3,842,985 | 10/1974 | Svede | 52/121 |
| 3,921,819 | 11/1975 | Spain | 212/144 |
| 3,987,594 | 10/1976 | Rao et al. . | |
| 4,057,942 | 11/1977 | Kranefeld et al. . | |
| 4,100,707 | 7/1978 | Kranefeld et al. . | |

FOREIGN PATENT DOCUMENTS

| | | | |
|---|---|---|---|
| 21377 | 5/1961 | Fed. Rep. of Germany . | |
| 257990 | 11/1971 | U.S.S.R. | 403/2 |

*Primary Examiner*—Trygve M. Blix
*Assistant Examiner*—Thomas J. Brahan
*Attorney, Agent, or Firm*—A. J. Moore; R. B. Megley

[57] ABSTRACT

A telescopic boom includes at least two sections and a manual section is sections being extended and retracted by a single hydraulic ram. A first coupling selectively connects or releases the ram's cylinder case from the second boom section while a second coupling connects or releases the other end of the cylinder case to the manual section. The first coupling includes a crank for coupling and uncoupling the cylinder case and second section. The second coupling includes a retrieval pin movable into position for connecting the cylinder case to the manual section when retracting the manual section within the second section, and releasable lock mechanisms are provided to lock the manual section in extended position. The method of operating the boom includes the step of pivoting the boom to a near vertical position prior to extending the manual section relative to the second section.

9 Claims, 15 Drawing Figures

APPARATUS FOR EXTENDING AND RETRACTING A MANUAL BOOM SECTION

BACKGROUND OF THE INVENTION

1. Field of the Invention

The present invention relates to an extensible boom for a crane, and more particularly relates to a method and apparatus for extending and retracting a manual boom section of a multi-section boom.

2. Description of the Prior Art

Cranes having multi-section telescopic booms with hydraulic rams within the booms for selectively extending and retracting the boom sections are, of course, well known in the art. Also, telescopic booms having a manual section and an intermediate section both of which must be extended and retracted by a single hydraulic ram are likewise well known in the art.

For example, Grove U.S. Pat. No. 3,386,594 which issued on June 4, 1968 and Johnston U.S. Pat. No. 3,795,321 which issued on Mar. 5, 1974 each discloses a four section telescopic boom that includes two hydraulic rams. One of the hydraulic rams has its piston rod connected to the inner intermediate power section and its cylinder case selectively connected to the outer powered intermediate section, or to the manual or tip section, for selectively extending and retracting the outer powered intermediate section or the manual section, respectively, relative to the next adjacent supporting boom section.

SUMMARY OF THE INVENTION

The method and apparatus of the present invention is illustrated in the drawings as a four section boom that is operated by two rams, with one ram having its piston rod connected to the inner powered section and having its cylinder case selectively connected to one end of the outer powered section by a crank operated mechanism when operating the boom as a three section boom. When operating the boom as a four section boom, the coupling mechanism is released from said one end of the cylinder case, the boom is then raised to a near vertical position and the cylinder is extended causing it to contact an abutment on the manual section thereby pushing the manual section to its extended position. When the manual section is fully extended by the ram, the boom is lowered to a generally horizontal position and the manual section is then latched to the outer powered section. The cylinder of the ram is then fully retracted and is connected to the outer powered boom section by the crank operated mechanism. The boom may then be operated by the two hydraulic rams in the conventional manner but with the manual section in its fully extended position.

DESCRIPTION OF THE PREFERRED EMBODIMENT

Figure 1:
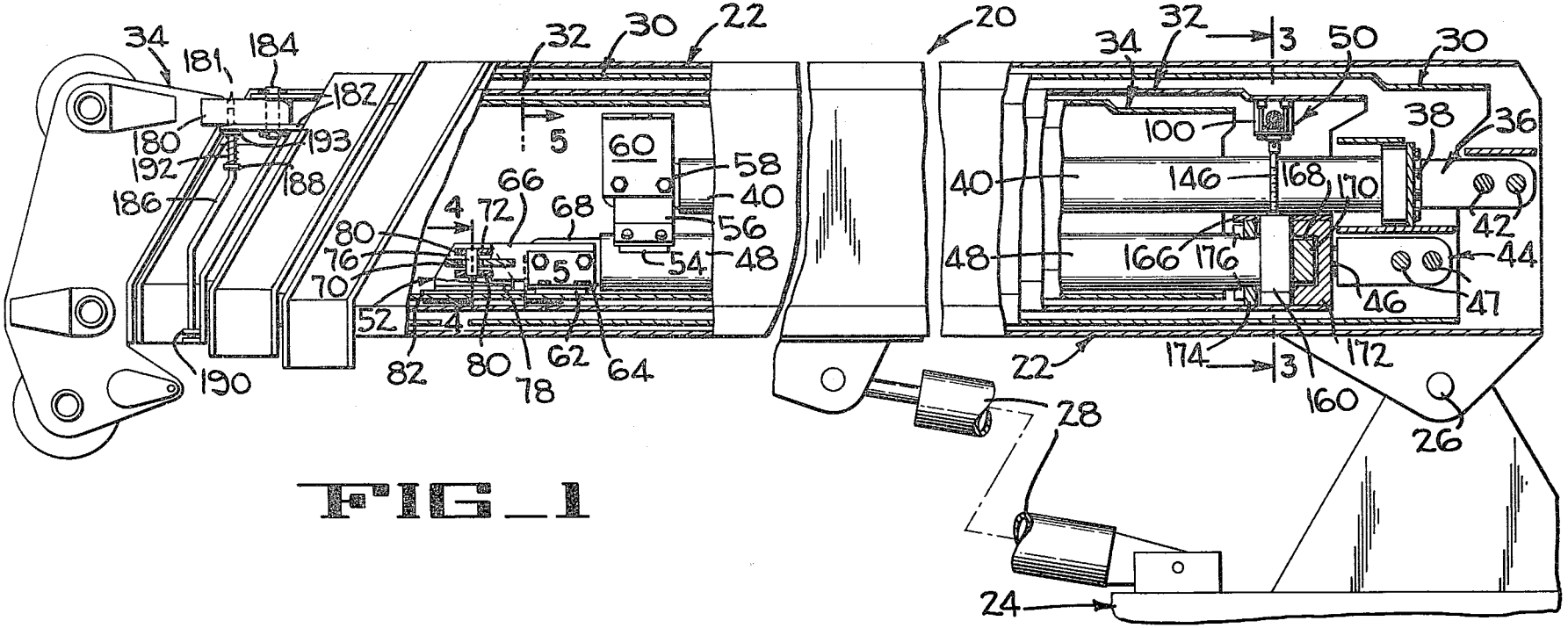
FIG. 1 is a side elevation of a four section boom of the first embodiment of the present invention which includes a manual section, said boom being illustrated in its fully retracted position with certain parts cut away and with the cylinder case of the lower hydraulic ram coupled to the outer powered section.

The telescopic boom 20 (FIGS. 1 and 2) of the present invention is preferably mounted on a hydraulic crane of the general type disclosed in the Tiffin et al U.S. Pat. No. 4,016,688 which issued on Apr. 12, 1977 and is assigned to the assignee of the present invention. The disclosure of this patent is incorporated herein by reference.

The boom 20 (FIGS. 1 and 2) comprises a base section 22 mounted on the upper works 24 of the crane by a shaft 26 for pivotal movement about a horizontal axis. The boom 20 is selectively raised and lowered by one or more hydraulic rams 28 pivotally connected between the base section 22 and the upper works 24.

The boom 20 includes the base section 22 which telescopically receives an inner or first powered section 30, an outer or second powered section 32, and a tip or manual section 34.

An upper hydraulic ram 36 includes a piston rod 38 and a cylinder case 40 with the rear end of the piston rod connected to the rear end of the base section 22 by pins 42. The rear end of the cylinder case 40 is connected to the first power section 30. Thus, extension and retraction of the upper ram 36 will extend and retract the inner powered section 30 along with the supported outer powered section 32, and manual section 34 as a unit relative to the base section.

A lower hydraulic ram 44 includes a piston rod 46 and a cylinder case 48 with the piston rod being connected to the inner powered section 30 by pins 47. The rear end of the cylinder case 48 is selectively connected to or released from the rear end of the inner powered section by a coupling mechanism 50, while the forward end of the cylinder is selectively connected to or released from the manual section 34 by a manual retrieving mechanism 52.

Figure 4:
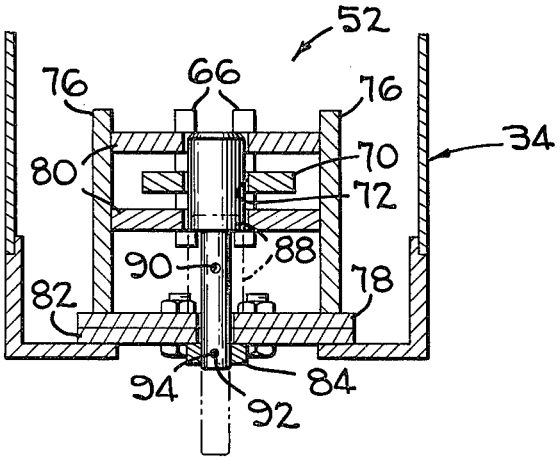
FIG. 4 is an enlarged transverse section taken along lines 4—4 of FIG. 1 illustrating a retrieving pin in solid lines connecting the outer end of the lower cylinder to the manual section, and in phantom lines disconnecting the outer end of the cylinders from the manual section.
Figure 5:
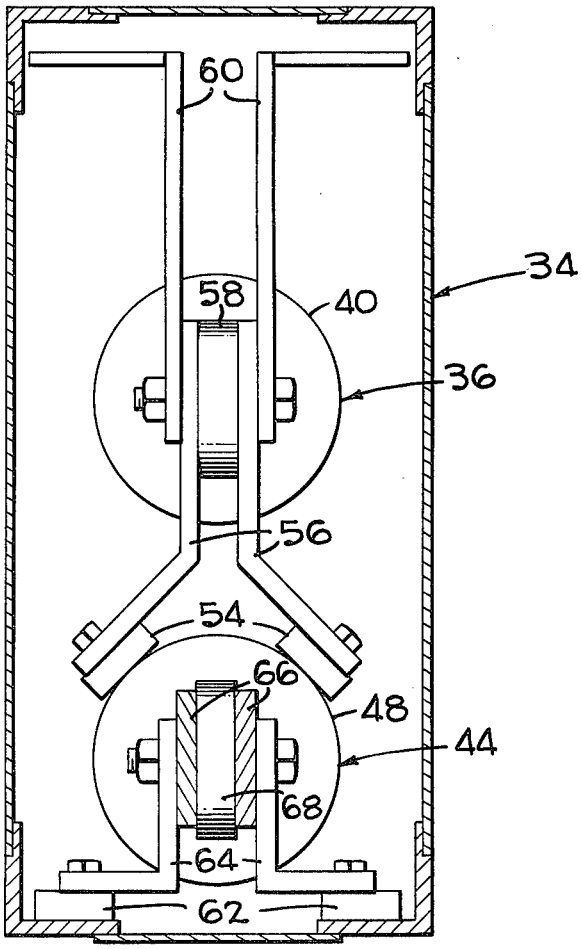
FIG. 5 is an enlarged transverse section taken along lines 5—5 of FIG. 1.
Figure 6:
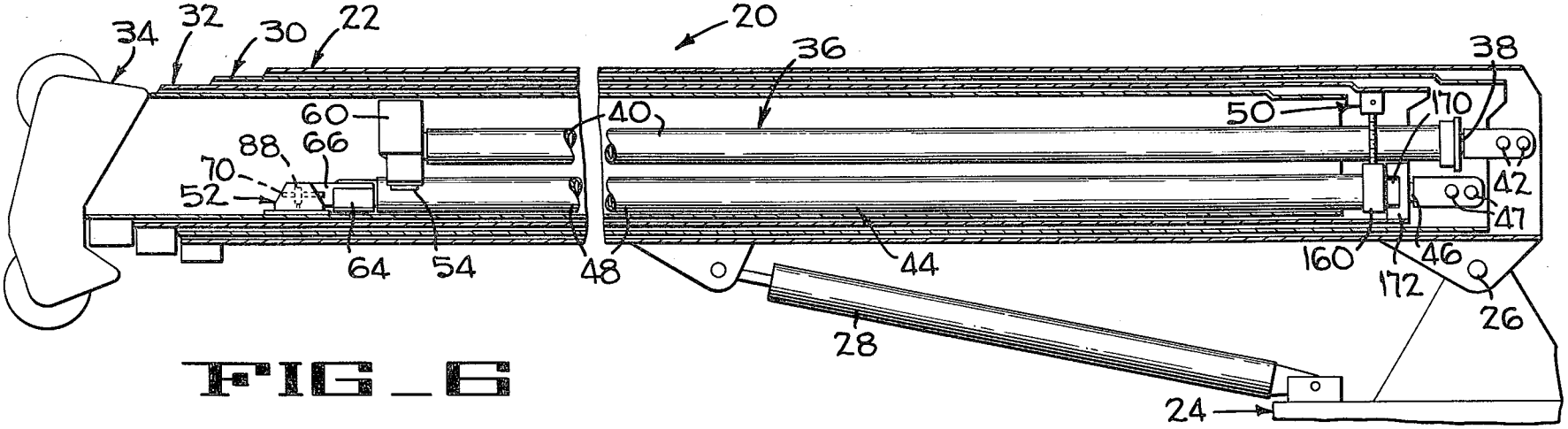
FIG. 6 is an operational view illustrating the coupling mechanism and a retrieving pin connected to the cylinder case of the lower ram thereby locking the manual section to the outer power section for three section telescopic operation.

As shown in FIGS. 1 and 5, the forward end of the upper cylinder case 40 is slidably supported on the upper surface of the lower cylinder case 48 by slide pads 54 which are bolted to angle straps 56 that are bolted to an abutment 58 on the end of the upper cylinder case 40. Upwardly extending angle guide straps 60 are also bolted to the abutment 58 and serve to maintain the upper cylinder case 40 and manual section 34 in longitudinal alignment. The forward end portion of the lower cylinder case 48 is slidably supported on the manual section 34 by slide pads 62 which are bolted to angle bars 64. The angle bars 64 and tongue straps 66 are bolted to an abutment 68 secured to the forward end of the lower cylinder case 48. A longitudinally extending tongue 70 (FIGS. 1 and 4) is welded to the tongue straps 66 and has a longitudinal slot 72 therein.

The manual retrieving mechanism 52 comprises a pair of spaced truncated triagular plates 76 which are welded to a base plate 78 and two pairs of tongue guide plates 80. The base plate 78 is bolted to a transverse plate 82 that is welded to the upper surface of the bottom of manual section 34. A boss 84 with aligned holes is welded to plate 78 and accepts spring clip 94 through the holes. The plates 78,80 and 82 are provided with properly sized and aligned holes which receive a retrieving pin 88 having a large diameter upper portion and a small diameter lower portion. The small diameter portion of the pin 88 (FIG. 4) is provided with an upper hole 90 and a lower hole 92 which selectively receives one leg of a spring clip 94 (which clip is preferably similar in shape to that disclosed in FIG. 15). When one leg of the spring clip 94 is inserted in through boss 84 and in the hole 92 and when the tongue 70 is positioned as illustrated in FIG. 4, the retrieving pin 88 is inserted within the slot 72 in the tongue 70 thereby connecting the manual section to the end of the lower cylinder case. Thus, when the lower ram is retracted the manual section will be telescoped to its retracted position within the outer section 32.

When said one leg of the spring clip is inserted through boss 84 and the upper hole 90, the retrieving pin 88 will be held in its inoperative position as shown in dotted lines in FIG. 4.

Figure 3:
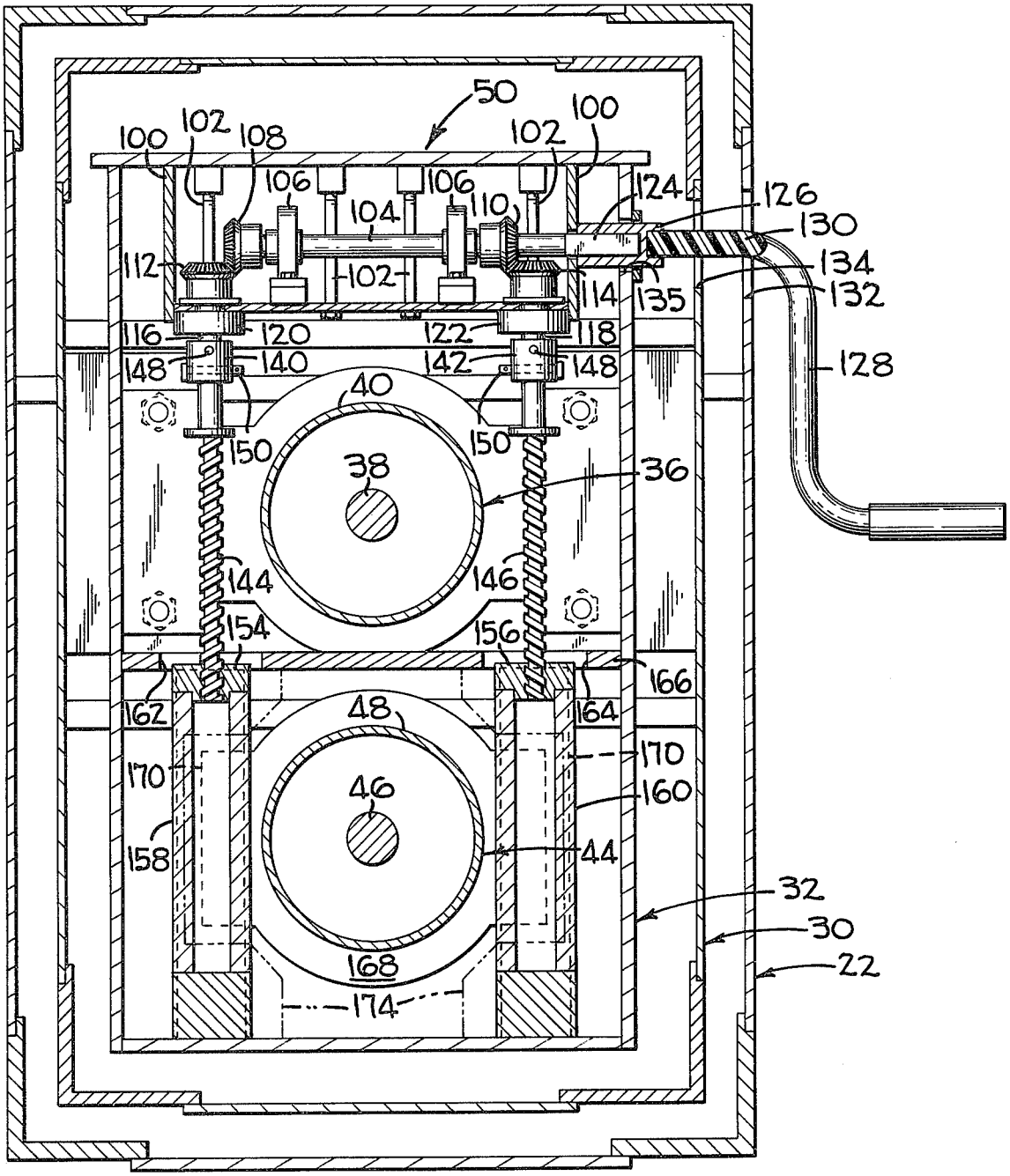
FIG. 3 is an enlarged transverse section taken along lines 3—3 of FIG. 1.

The coupling mechanism 50 (FIGS. 1 and 3) is secured to the outer powered section 32 of the boom 20. The mechanism 50 includes a generally U-shaped upper frame 100 which is connected to the top of the boom section 32 by cap screws 102 (FIG. 3). A shaft 104 is journaled in bearings 106 bolted to the frame 100 and has bevel gears 108,110 keyed thereto, which gears 108,110 mesh with bevel gears 112,114 secured to stub shafts 116, 118 journaled in bearings 120,122 secured to the frame 100. The shaft 104 has a non-circular, preferably square end portion 124 which slidably receives the similarly shaped hub 126 of a crank 128. The crank includes a portion 130 which is made of an easily breakable material, such as plastic or the like. The crank 128 is connected in cranking engagement with the shaft 104 through holes 132,134 and 135 in the base section 22, the inner powered section 30, and the outer powered section 32 of the boom 20 when the coupling mechanism 50 is to be operated. Thus, if the operator neglects to remove the crank 128 prior to extending one of the boom sections with the crank in the FIG. 3 position, the crank will easily break thus preventing damage to the other components of the crane.

Universal joint connectors 140,142 are interconnected between the stub shafts 116,118 and the right and left hand screws 144,146, respectively, by means of roll pins 148 and removable pins 150 held in place by cotter pins or the like. The screws 144,146 are threaded into caps 154,156 of vertically movable abutment means or firing bars 158,160 which are guided through rectangular openings 162,164 in a transverse plate 166 welded to the side walls of the outer powered section 32.

As shown in FIGS. 1 and 3, a collar 168 is rigidly secured to the rear end of the cylinder case 48 of the lower ram 44 and includes a pair of ears 170 as shown in dotted lines in FIG. 3. Each ear 170 is received in an associated vertical plate which is shaped in the form of a C-block 172 (one of said C-blocks being shown in section in FIG. 1). Each C-block is rigidly secured to the outer powered section rearwardly of the associated firing bar 158 or 160 when the lower cylinder 48 is fully retracted.

Forwardly of the C-blocks 172 and firing bars 158,160 a spaced pair of vertical firing bar guide posts 174 (outlined in phantom lines in FIG. 3) are secured to the outer powered boom section 32 and are spaced apart a sufficient distance to permit the cylinder case 48 and collar 168 (including its ears 170) to move therepast when the firing bars 158,160 are raised to their inactive positions and the cylinder case 48 is extended toward the left (FIG. 1) relative to its piston rod 46. A pair of beveled guide plates 176 (FIG. 1) are secured to each guide post 174 and serve to assist in guiding the ears 170 into the C-blocks 172 when the cylinder case 48 is fully retracted.

Figure 2:
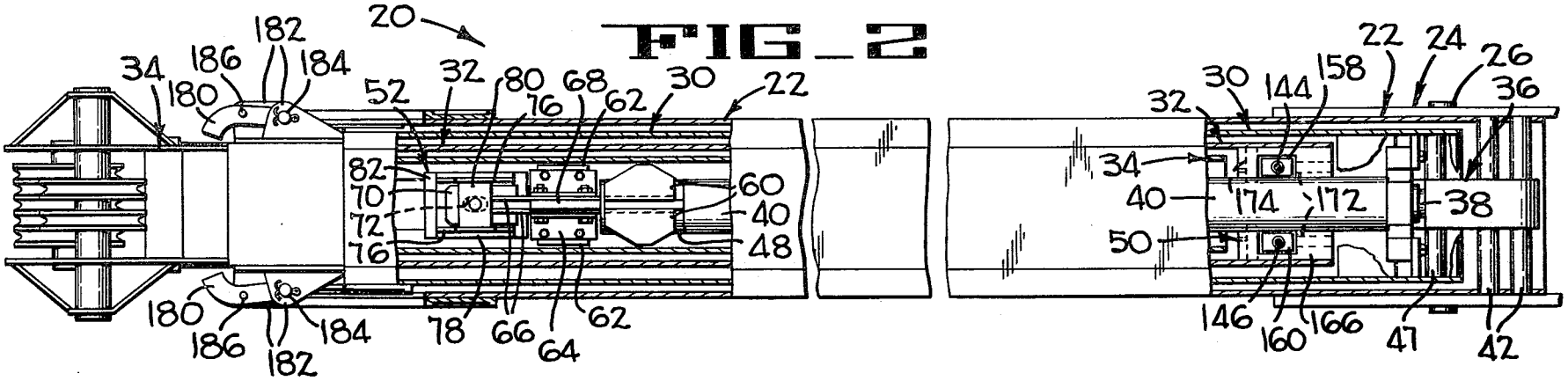
FIG. 2 is a plan view of the boom of FIG. 1 with certain parts cut away and other parts shown in section.

When the firing bars are cranked into their lowered operative positions as illustrated in FIGS. 1 and 2, it will be apparent that extension of hydraulic ram 44 by hydraulic control means (not shown) will cause the ears 170 to engage the firing bars 158,160 causing the firing bars to engage the guide posts 174 thus causing the outer powered section 32 to move to the left (FIG. 1) with the cylinder case 48. Of course, the manual section 34 and the outer powered section 32 will move as a unit relative to the section 30 at this time.

When the firing bars 158,160 are raised to their inactive positions, high pressure fluid entering the lower cylinder case 48 will move the cylinder case 48 to the left (FIGS. 1 and 2) relative to its piston rod 46. This movement will cause the outer ends of the tongue straps 66 to engage the adjacent edges of tongue guide plates 80 thereby pushing the manual section 34 outwardly of the outer powered section 32 to its fully extended position in a manner to be discussed in more detail later.

Figure 9:
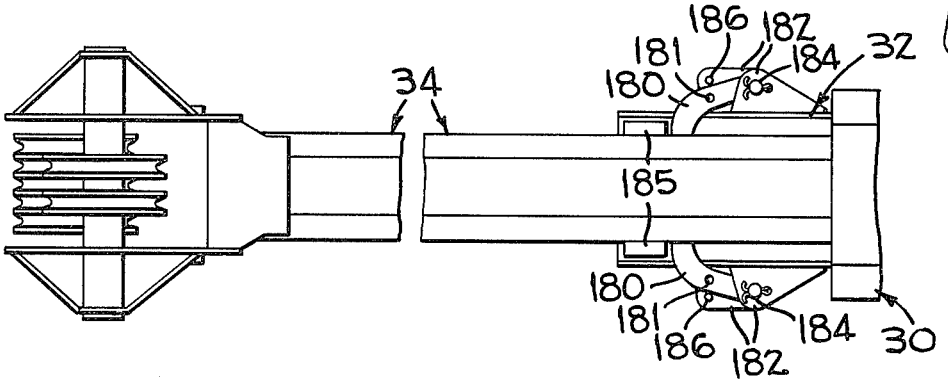
FIG. 9 is an operational view in plan illustrating the manual section latched to the outer powered section in its extended position, said boom having been lowered to a generally horizontal position prior to latching.

In order to lock the manual section 34 in its extended position relative to the outer power section 32, a pair of locking latches 180 (FIGS. 1, 2 and 9) are pivotally connected on opposite sides of the outer powered section 32 by yokes 182 and pivot pins 184. The latches 180 are pivoted into locking position behind abutments 185 rigidly secured to the manual section 34 as shown in FIG. 9. A locking bar 186 is associated with each latch 180, and each bar is mounted for vertical movement in holes 181 in the latches, in associated yokes, and in holes in the apertured tabs 188,190 (FIG. 1) secured to the outer powered section. A compression spring 192 is disposed between each upper tab 188 and an abutment 193 on the locking bar 186 to resiliently maintain the locking bar in its raised position as illustrated in FIG. 1. When the locking latches 180 are positioned to lock the manual section out as shown in FIG. 9, the upper portions of the raised locking bars 186 are disposed outwardly of the latches thus preventing them from pivoting out of engagement with the abutments 185. When it is desired to retract the manual section 34, the bars 186 are pulled down, the latches 180 are swung to their inactive outer positions of FIG. 2. The latches are held in their inactive positions by inserting the upper ends of the bars 186 in holes 181 provided in the latches 180 as shown in FIGS. 1 and 2.

The method of reliably extending and retracting the three boom sections 30,32 and 34 relative to the base section 22 of the boom 20 using the two hydraulic rams 36 and 44 will now be described with the aid of FIGS. 6–10.

Figure 7:
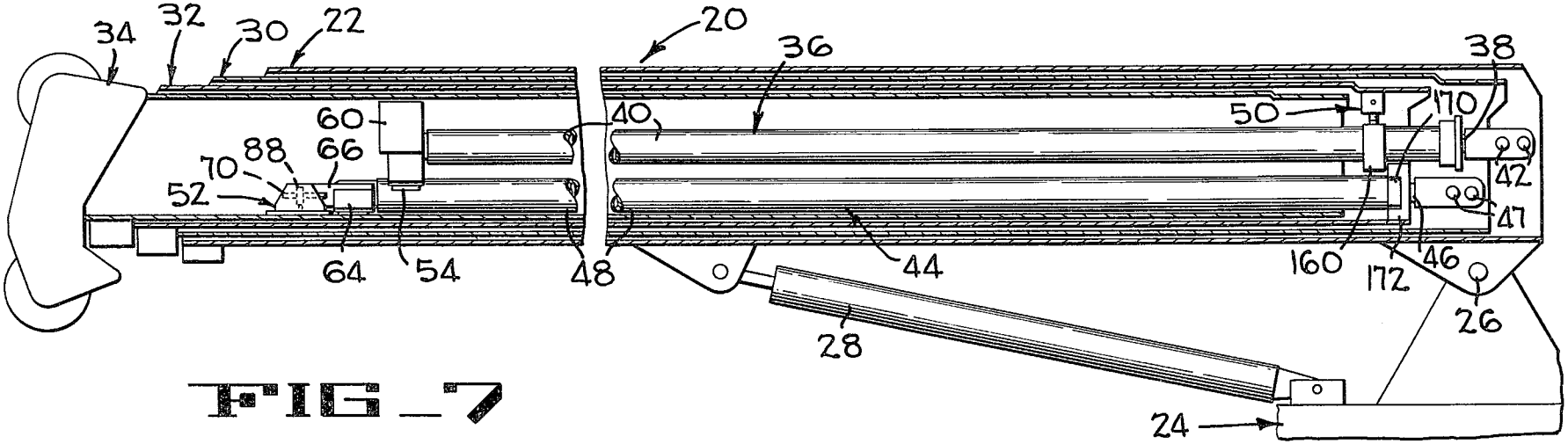
FIG. 7 is an operational view similar to FIG. 6 but illustrating the coupling mechanism disconnected from the cylinder case of the lower ram.

In order to prepare the manual section 34 (FIGS. 1 and 6) of the boom 20 of the first embodiment of the present invention for extension, the boom 20 is lowered to its full down position, all boom sections are retracted, and the retrieval pin 88 is in its raised active position (FIG. 4). The crank 128 (FIG. 3) is then connected to the shaft 104 of the coupling mechanism 50 and is manually rotated in the proper direction to raise the firing bars 158,160 from their active positions (FIG. 6) to their inactive positions (FIG. 7).

Figure 8:
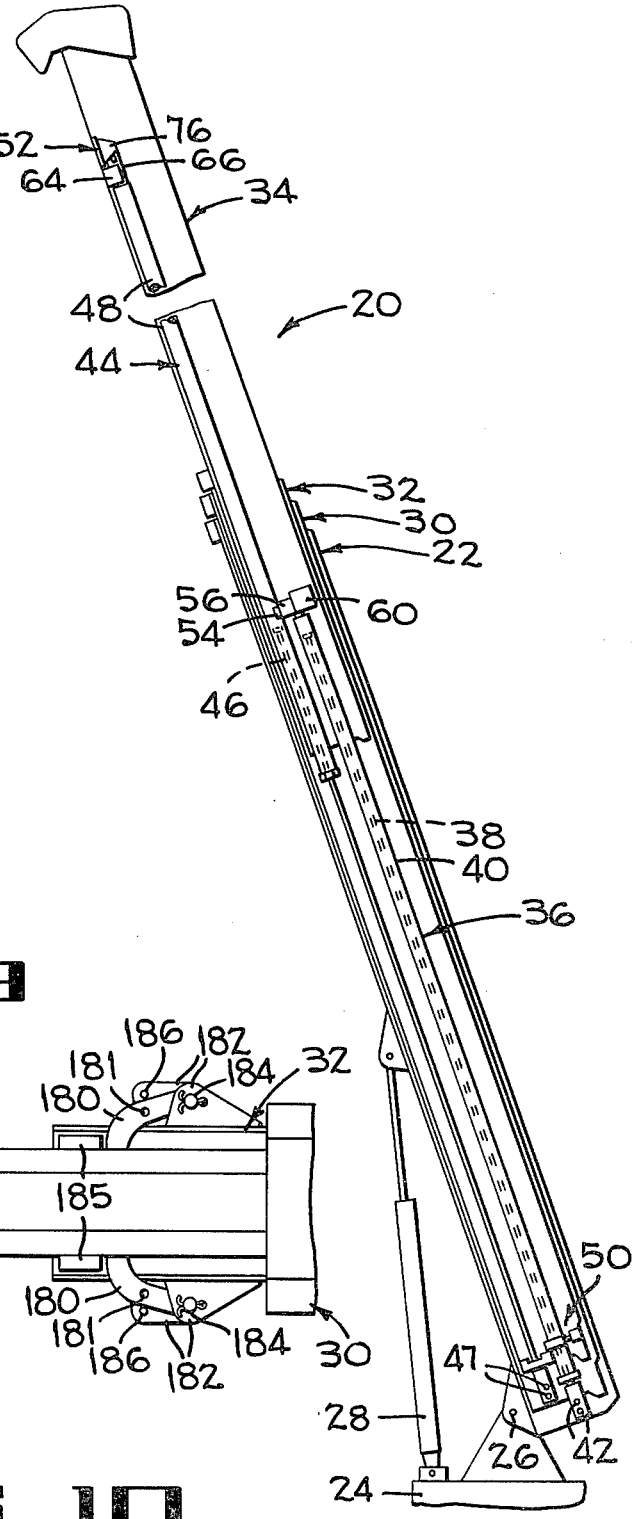
FIG. 8 is an operational view with the manual section extended and with the boom raised to a near vertical position (about 70°) for eliminating slack by gravitationally preventing the outer powered section from movement outwardly with the manual section during extension due to frictional engagement.

The boom elevating ram 28 (FIG. 8) is then activated by conventional hydraulic means to raise the boom to a near vertical position (about 70° above the horizontal). In this way, the friction between the manual section and the outer powered boom section 32 is reduced to a minimum thereby obviating the need to lock the outer powered section from movement. The lower ram 44 is then fully extended causing the forward ends of the tongue strap 66 on the forward end of the cylinder case 48 to engage the plates 80 (FIG. 4) of the retrieving mechanism 52, which mechanism is secured to the manual section 34 thereby fully extending the manual section as shown in FIG. 8.

The boom 20 is then fully lowered and the locking latches 180 (FIG. 9) are pivoted behind the abutments 185 on the manual section 34 and are locked in place by the locking bars 186 as shown in FIG. 9. The lower cylinder case 48 is then released from the manual section 34 by moving the retrieving pin 88 to its dotted line position in FIG. 4, and the cylinder case 48 is fully retracted to the position shown in FIG. 10. The crank 128 is then rotated in the opposite direction to lower the firing bars 158,160 to their FIG. 10 positions thereby latching the lower cylinder case 48 to the outer powered section 32. The crank 128 is then removed, and the boom is raised to a near vertical position to remove the gap between the lock out latches 180 and the abutments 185. The upper ram 36 and lower ram 44 are then operated in a conventional manner to extend and retract the inner and outer boom section with the manual section locked in extended position.

Figure 10:
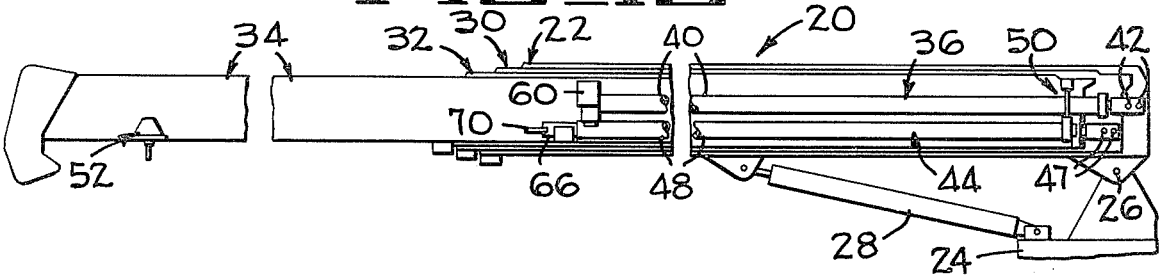
FIG. 10 illustrates the manual section in its extended position and the coupling mechanism connected to the cylinder of the lower ram for extending and retracting the outer powered section and the manual section as a unit.

The procedure for retracting the manual section 34 is as follows:

The boom is first lowered to its fully down position with the powered sections 32 and 30 retracted as shown in FIG. 10. The firing bars 158,160 of the latch mechanism 50 are then raised to their inactive upper positions by manually cranking them up. The boom 20 is then raised to a near vertical position and the lower ram 44 is extended. The lower cylinder case 48 is then connected to the manual section 34 by inserting the retrieval pin 88 through the slot 72 in the tongue 70 and locking it in place with the spring clip 94. The locking bars 186 (FIG. 1) are then pulled down releasing the latches 180 from behind the abutments 185 (FIG. 9) and are then held in inactive position by inserting the upper ends of the bars in holes 181 (FIGS. 1 and 2) in the latches 180. The lower ram 44 is then fully retracted; the firing bars 158, 160 are lowered to couple the cylinder case 48 to the outer powered section 32. The crank 128 is then removed and the boom 20 is in condition to be operated as a three section boom with the manual retracted. The retrieval pin 88 remains in the upper active position to hold the manual section 34 in retracted position within the outer powered section 32.

A second embodiment of the boom 20*a* is illustrated in FIGS. 11 through 14 and is quite similar to the boom 20 except for the specific details of a different type of coupling mechanism 50*a* and a different locking system 200 for selectively locking the manual section 34*a* to the outer powered section 32*a* either in its extended or retracted positions. Accordingly, only the new components will be described in detail, and components of the boom 20*a* which are similar to those of the boom 20 will be assigned the same numerals followed by the letter "a".

Figure 11:
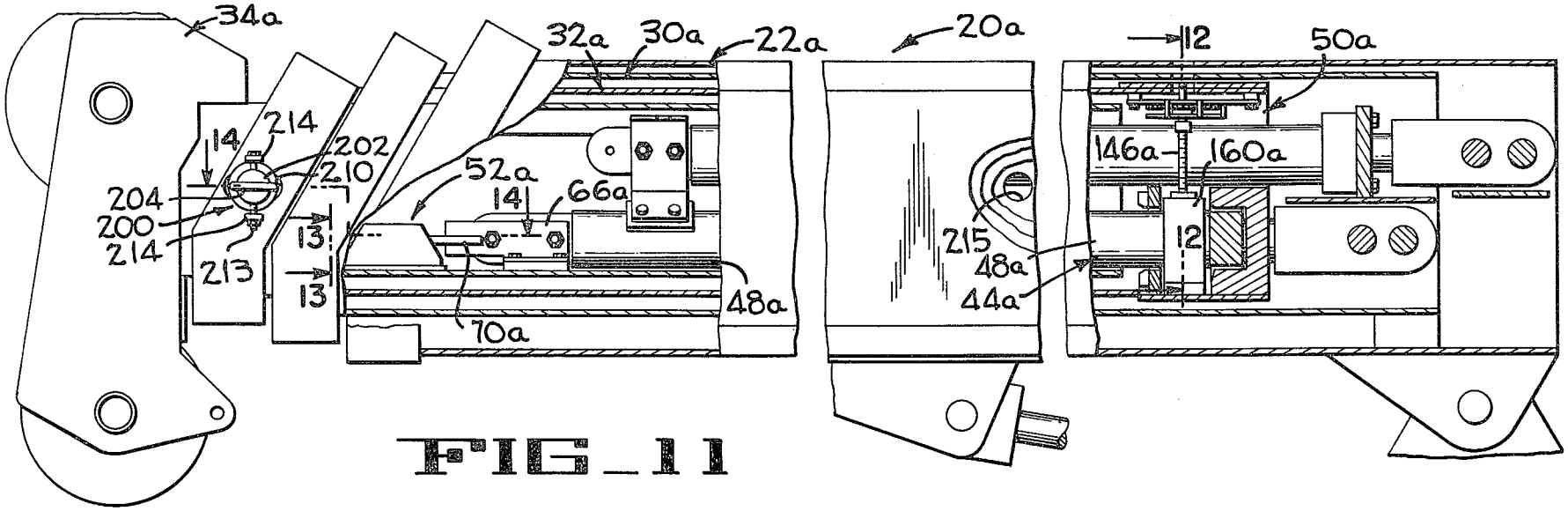
FIG. 11 is a side elevation with parts cut away illustrating a second embodiment of the invention, said second embodiment featuring a vertical axis crank operated coupling mechanism and a pin type latch for selectively latching the manual section in its extended or retracted positions.
Figure 14:
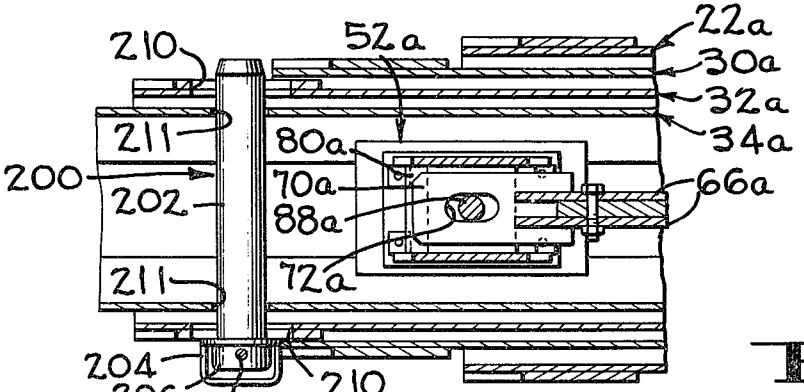
FIG. 14 is a longitudinal section taken along lines 14—14 of FIG. 11 illustrating the manual section pinned to both the outer powered section and to the outer end of the cylinder case of the lower ram for subsequent retrieval.

The locking system 200 comprises a heavy duty lock out pin 202 having a chamfered outer end, and a handle 204 secured to a wide based aperture collar 206 on the other end of the pin. As shown in FIGS. 11 and 14, the lock out pin 202 is inserted through axially elongated slots 210 in the outer powered section 32*a* and in holes 211 in the manual section 34*a*. Thus, ample clearance is provided enabling the lock out pin 202 to be easily inserted through the slots and holes to lock the manual section 34*a* in its retracted position. The pin 202 is held in place by the pin 213 which extends through aligned holes in ears 214 welded to the outer powered section 32*a* and through a hole in the lock out pin 202. A second pair of holes 215 (FIG. 11) in the manual section 34*a* receives the lockout pin 202 when the holes 215 are aligned with the slots 210 to lock the manual section 34*a* in its extended position.

Figure 12:
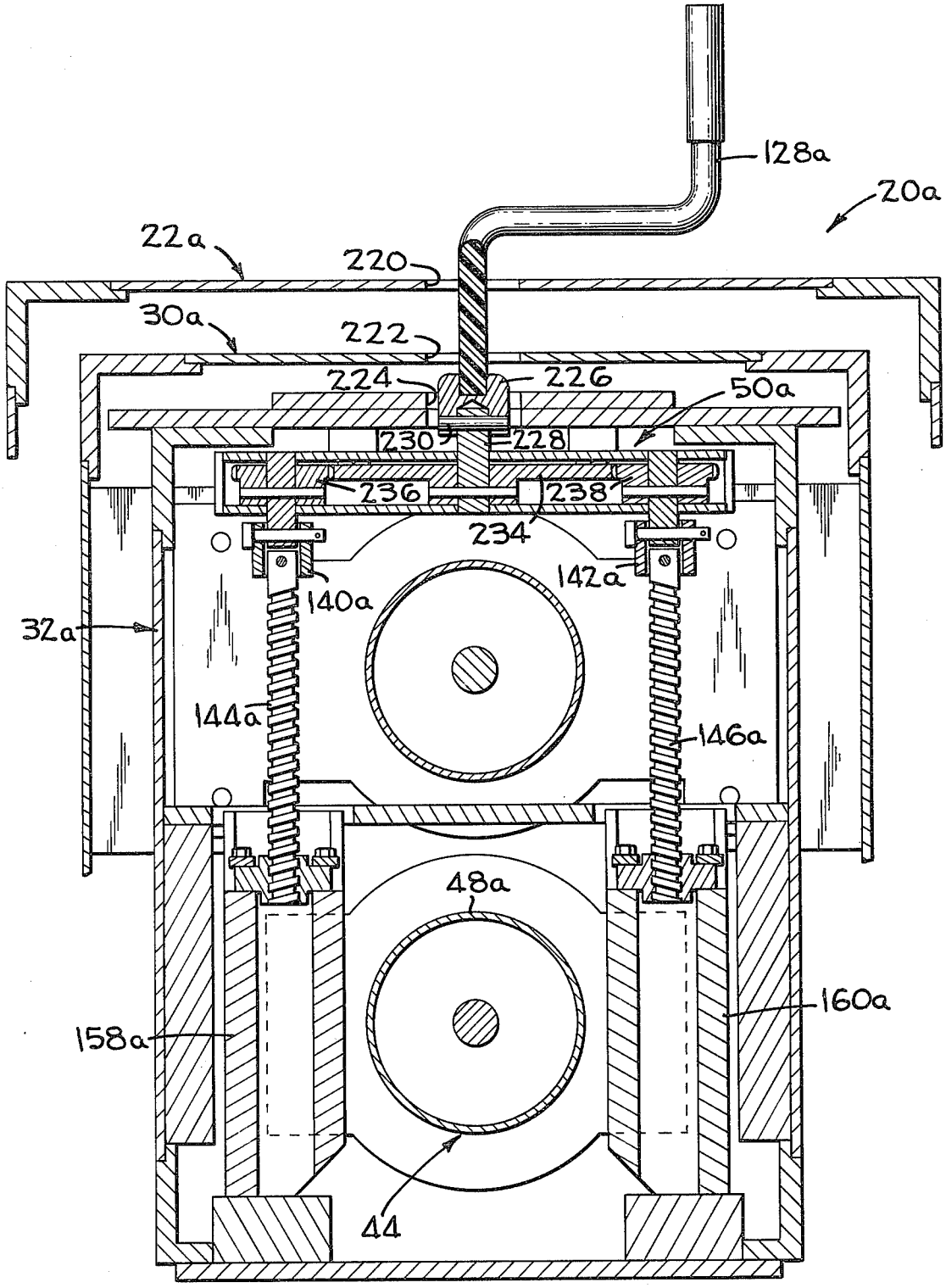
FIG. 12 is a transverse section taken along lines 12—12 of FIG. 11 illustrating the vertical axis crank operated coupling mechanism locked to the cylinder case of the lower ram.

As shown in FIGS. 11 and 12, the coupling mechanism 50*a* differs from the coupling mechanism of the first embodiment primarily because it is arranged to be actuated by a crank 128*a* that is rotated about a vertical axis rather than a horizontal axis. A portion of the crank 128*a* extends through openings 220,222, and 224 in the base section 22*a*, inner power section 30*a*, and outer power section 32*a*, respectively. The crank includes a drive hub 226 secured to its driving end, which hub 226 fits over a stub shaft 228 and is slotted to receive a pin 230 secured to the upper end of the stub shaft to drive the same upon rotation. The lower end of the stub shaft is pinned to a large diameter gear 234 which drives pinions 236, 238 that are connected to right and left hand screws 144*a*,146*a*, respectively, by universal joint connectors 140*a*,142*a*. The screws 144*a*,146*a* are threaded into the firing bars 158*a*,160*a*. Thus, manual rotation of the crank 128*a* in one direction raises the firing bars 158*a*,160*a* to their inactive position releasing the cylinder case 48*a* of the lower ram 44*a*; while rotation of the crank in the opposite direction lowers the firing bars to the position illustrated in FIG. 12 and couples the cylinder case 48*a* to the outer powered boom section 32*a*.

Figure 13:
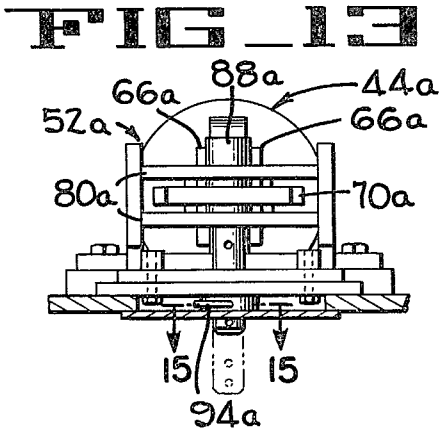
FIG. 13 is a transverse section taken along lines 13—13 of FIG. 11 illustrating the outer end of the cylinder case of the lower ram pinned to the manual section.

FIGS. 13 and 14 illustrate the manner in which the retrieving pin 88*a* of the retrieving mechanism 52*a* is received in the slot 72*a* in tongue 70*a*; and the manner in which the tongue supporting straps 66*a* contact the inner edges of the tongue guide plates 80*a* (only one shown in FIG. 14) to push the manual section 34*a* outwardly relative to the outer powered section 32*a* upon extension of the cylinder case 48*a*.

Figure 15:
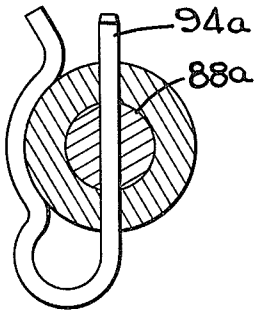
FIG. 15 is a section taken along lines 15—15 of FIG. 13 illustrating a spring hitch clip for selectively locking the retrieval pin in engaged or disengaged position with said lower cylinder case.

FIGS. 13 and 15 illustrate the spring clip 94*a* and the manner in which one leg thereof is inserted through aligned holes to selectively maintain the retrieving pin 88*a* (FIG. 13) in either its active solid line position or its inactive dotted line position.

Since the manual boom extending operation is substantially the same as discussed in regard to the first embodiment of the invention, the entire operation will not be repeated. It will be understood, however, that the lock out pin 202 is removed prior to elevating the boom 20*a* to its near vertical position for extension of the manual section 34*a*; and that the lockout pin 202 is thereafter installed in the slots 210 and holes 215 (FIG. 11) after the boom has been lowered.

In order to retract the manual section 34*a*, the firing bars 158*a*,160*a* are first cranked to their upper inactive positions when the boom is fully down, the boom 20*a* is then raised to a near vertical position, the lower cylinder case 48*a* is then fully extended and thereafter the boom is fully lowered. The lower cylinder case 48*a* is then connected to the manual section by moving and locking the retrieval pin 88*a* from its inactive to its raised active position within the slot 72*a* of the tongue 70*a*. The lock out pin 202 is then removed, the cylinder case 48*a* is retracted to retract the manual section 34*a*, the firing bars 158*a*,160*a* are lowered to lock the cylinder case 48*a* to the outer powered section 32*a*. The lock out pin 202 is then inserted in holes 211 and slots 210 and is then locked in place by the pin 213 thereby completing the retracting process.

From the foregoing description it is apparent that a new method and apparatus has been disclosed for more easily extending or retracting the manual section of a boom relative to an outer powered section by employing a crank operated coupling mechanism, a selectively operable latching mechanism to latch the manual boom section in its outer position, and a retrieval mechanism for selectively connecting or releasing a hydraulic cylinder to the manual section.

Although the best mode contemplated for carrying out the present invention has been herein shown and described, it will be apparent that modification and variation may be made without departing from what is regarded to be the subject matter of the invention.

What is claimed is:

1. In a multi-section extensible telescopic boom having at least three boom sections mounted for telescopic movement within each other, a multi-piece extensible and retractable power means having one piece connected to one of said telescopic sections; the improvement comprising first selectively operable coupling means solely supported by and disposed within a second boom section for selectively connecting and disconnecting another piece of said power means to the second boom section, second selectively operable coupling means operatively connecting said another piece of said power means to said third boom section for extending and retracting said third boom section relative to said second boom section in response to extension and retraction of said power means when said first coupling means is released, means for releasably locking said third boom section to said second section in extended position, and removable crank means engageable with said first coupling means for moving said first coupling means between said position connecting said another piece of said power means to said second boom section and said released position by operating said crank means in opposite directions.

2. An apparatus according to claim 1 wherein said second selectively operable coupling means includes a manually operated retrieval mechanism comprising a tongue rigidly secured to one end of said another piece of said power means in position remote from said first coupling means, means defining a longitudinal slot in said tongue, means defining a pushing surface on said slotted tongue, bracket means secured to said third boom section in position to receive said slotted tongue and to be engaged by said pushing surface, retrieval pin means supported by and slidably received in said bracket for movement between a retrieval position within said slotted tonque and an inactive position supported by said bracket but spaced from said slotted tongue, and means for selectively locking said pin in said retrieval position or in said inactive position, said power means being extended when said first coupling means is released causing said pushing surface to engage and push said bracket and third boom section outwardly of said second boom section, retraction of said power means when said first coupling mechanism is released and said pin means is in retrieval position being effective to retract said third boom section within said second boom section.

3. An apparatus according to claims 1 or 2 wherein said first coupling means is crank operated and wherein said boom is mounted for pivotal movement about a pivot axis on the upper works of a crane and wherein the crank is rotatable about a vertical axis by the crane operator when supported by the upper works; said first coupling means being adjacent said pivot axis and being responsive to rotation of the crank in one direction for connecting said another piece of said power means to said second boom section, and being responsive to rotation of the crank in the opposite direction to release said another piece of said power means from said second boom section.

4. In a multi-section extensible telescopic boom having a base section, an inner powered section, an outer powered section and a manual section mounted for telescopic movement within each other, a first hydraulic ram having a piston rod connected to said base section and a cylinder case connected to said inner powered section for selectively extending or retracting said inner powered section relative to said base section, a second hydraulic ram having a second piston rod connected to said inner powered section and having a second cylinder case, first coupling means supported by and disposed solely within said outer powered section and selectively connected to or released from one end of said second cylinder case, second coupling means disposed within said manual section and including a movable retrieval pin carried thereby for operatively connecting or releasing the other end of said second cylinder case to said manual section, extension of said second ram being responsive to operatively engage said second coupling means to effect extension of said manual section relative to said outer powered section when said first coupling means is released; means selectively locking said manual section to said outer powered section when extended; retraction of said second ram being responsive to retract the extended manual section and said outer powered section as a unit when said manual section is locked in extended position; when said first coupling means is disconnected and said second coupling means is connected and when said locking means is released, retraction of said second ram being responsive to retract said manual section within said outer powered section.

5. An apparatus according to claim 4 and additionally comprising means for mounting said base section for pivotal movement about a horizontal axis, and power means for pivoting said boom about said axis between a near vertical and a generally horizontal position, said manual section being extended relative to said outer powered section when said boom is in said near vertical position for minimizing friction between said manual section and said outer powered section and for maintaining said outer powered section in its retracted position during extension of said manual section.

6. In a multi-section telescopic boom including three telescopic sections and with a hydraulic ram provided to extend and retract said sections, the piston rod of the ram being connected to one section and the cylinder case of the ram being selectively connected to the second and third sections; the improvement comprising first coupling means solely supported by and disposed within said second section for selectively connecting one end of the cylinder case to said second boom section when said ram and said first and second boom sections are fully retracted; said coupling means including fixed abutment means on said one end of said cylinder case defining a transverse abutment surface, a transversely movable abutment means carried solely by said second boom section and movable between a coupled position engaging said first abutment surface and a released position spaced from said surface; and removable crank means for moving said movable abutment means between said two positions.

7. An apparatus according to claim 6 wherein said boom is mounted for pivotal movement about a pivot axis on the upper works of a crane; said abutment moving means including a removable crank turned by the crane operator when supported by the upper works, and means disposed between said movable abutment means and said crank for moving said movable abutment means between said two positions in response to rotation of said crank in the proper directions.

8. An apparatus according to claim 6 and additionally comprising second coupling means for selectively and operatively connecting the other end of said cylinder case to said third section for extending and retracting said third section when said first coupling means is in its uncoupled position, said second coupling means including abutment means on said other end of said cylinder case, a tongue having a longitudinal slot therein, bracket means secured to said third section and including abutment surfaces in position to be engaged and pushed outwardly by said abutment means on said other end of said cylinder case upon extension of said ram, and a retrieval pin supported by said bracket and movable between a retrieval position within the slotted tongue and an inactive position while remaining in supported position with said bracket, said pin being inserted within the slot in said tongue for retracting said third section within said second boom section in response to retracting said ram.

9. An apparatus according to claim 8 and additionally comprising means for pivoting said boom to a near vertical position, said boom pivoting means maintaining said boom in said near vertical position during extension of said third section relative to said second section.

* * * * *